US008469251B2

(12) United States Patent
Clark et al.

(10) Patent No.: US 8,469,251 B2
(45) Date of Patent: Jun. 25, 2013

(54) STAPLING TOOL FOR HARDWOOD PLANK STAPLES

(75) Inventors: Jack Clark, Buffalo, MN (US); Scott Marschel, Maple Lake, MN (US); Greg Chambers, Morgan Hill, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 294 days.

(21) Appl. No.: 12/904,916

(22) Filed: Oct. 14, 2010
(Under 37 CFR 1.47)

(65) Prior Publication Data

US 2011/0108601 A1 May 12, 2011

Related U.S. Application Data

(63) Continuation-in-part of application No. 12/324,650, filed on Nov. 26, 2008, now Pat. No. 7,837,078.

(51) Int. Cl.
*B25C 7/00* (2006.01)

(52) U.S. Cl.
USPC ..... 227/148; 227/147; 227/119

(58) Field of Classification Search
USPC ..... 227/147, 148, 119, 120, 130, 156, 227/107
See application file for complete search history.

(56) References Cited

U.S. PATENT DOCUMENTS 1,016,383 A 2/1912 Wellman
1,213,334 A 1/1917 Chapman
2,768,376 A 10/1956 Critchley
3,012,247 A 12/1961 Sillars et al.
3,360,176 A 12/1967 Gehl et al.
3,764,053 A 10/1973 Thompson
3,864,053 A 2/1975 Harwood
4,084,738 A 4/1978 Schneider
4,085,382 A 4/1978 Barber et al.
4,196,833 A 4/1980 Haytayan
4,450,998 A 5/1984 Ruskin
4,838,471 A 6/1989 Chiesa
4,858,813 A 8/1989 Wingert
4,903,882 A 2/1990 Long
4,907,730 A 3/1990 Dion
5,062,562 A 11/1991 Michael
5,868,183 A 2/1999 Kozyrski et al.
5,967,397 A 10/1999 Fealey
6,095,392 A * 8/2000 Batts et al. ..... 227/8
6,155,472 A 12/2000 Deziel
6,269,996 B1 8/2001 McAllister
6,318,620 B1 11/2001 Anstett et al.
6,527,156 B2 3/2003 McAllister et al.

(Continued)

*Primary Examiner* — Brian D Nash
(74) *Attorney, Agent, or Firm* — Schneck & Schneck; David M. Schneck

(57) ABSTRACT

A stapling tool for hardwood flooring staples and hardwood tongue and groove flooring planks is disclosed. The tool has a body that includes a body base surface, a stop surface, a body top surface and a staple slot. The tool has a rod assembly that includes a hammering head and a staple driving head. A hardwood flooring staple, inserted into the staple slot, followed by the staple driving head, is guided by the staple slot. In response to impact force received by the hammering head from a head of a hammer, the staple driving head drives the hardwood flooring staple into an external angle formed by the tongue and the outside edge of the plank. The staple may be inserted from beyond a plane defined by the body top surface. The staple slot may be at an angle greater than 45 degrees, less than or equal to 85 degrees.

21 Claims, 21 Drawing Sheets

U.S. PATENT DOCUMENTS

| | | | | |
|---|---|---|---|---|
| D493,079 | S | 7/2004 | Fowler | |
| 6,843,402 | B2 | 1/2005 | Sims et al. | |
| 7,243,832 | B2 | 7/2007 | Jiang | |
| 7,255,256 | B2 | 8/2007 | McGee et al. | |
| 7,303,105 | B2 | 12/2007 | Dion et al. | |
| 8,186,554 | B2 * | 5/2012 | Abla | 227/148 |
| 2007/0017953 | A1 | 1/2007 | Hamar | |
| 2007/0057013 | A1 | 3/2007 | Deziel | |
| 2007/0257081 | A1 | 11/2007 | Dion et al. | |
| 2007/0296341 | A1 | 12/2007 | Hsieh et al. | |

* cited by examiner

CCC - 017

CCC - 017

CCC - 017

STAPLING TOOL FOR HARDWOOD PLANK STAPLES

CROSS-REFERENCE TO RELATED APPLICATION

This application is a continuation-in-part of U.S. non-provisional patent application Ser. No. 12/324,650, filed Nov. 26, 2008.

TECHNICAL FIELD

The present invention relates to stapling tools and flooring tools and more specifically to stapling tools for hardwood plank staples.

BACKGROUND

In the installation of tongue and groove hardwood plank flooring materials, pneumatic staplers are commonly used to drive staples used to adhere the planks to the floor. These staplers are designed to sit flat on top of the hardwood plank and locate against a tongued side of the plank such that they can precisely drive the staple at a 45 degree angle at a point just above the tongue. The driving angle of 45 degrees and driving elevation at the point just above the tongue are fixed and standard for most modern pneumatic hardwood staplers. The standard angle and point of entry for driving staples works well because the hardwood planks themselves normally have standard tongue and groove dimensions.

FIG. 8 shows the shape of a typical modern hardwood staple 50. As used herein, a typical hardwood staple 50 has dimensions defined as follows: dimension 51 is the length of the hardwood staple (sometimes also referred to as a "leg"), dimension 52 is the width of the hardwood staple (sometimes also referred to as a "crown"), and dimension 53 is the thickness of the hardwood staple. Modern hardwood staples are typically wire form products made from round wire. Hence the crown 52 of this kind of staple tends to form a longitudinally rounded surface 54. In comparison to other staples, modern hardwood flooring staples have long, brittle legs that will easily break if they are not supported during the driving process.

FIG. 5 illustrates by way of a cross sectional view the proper stapling of a tongue and groove hardwood plank. A first plank 11 has a hardwood staple 12 driven fully at a 45 degree angle into the vertex 13 of the exterior angle formed by an outer edge 14 and a tongue 15 of first plank 11. Hardwood staple 12 anchors first plank 11 to subfloor 16. Provided hardwood staple 12 is fully driven into the vertex 13 of first plank 11, the tongue 15 of plank 11 fits easily into groove 18 of second plank 17, and the stapling process continues by stapling at same area of the next plank (vertex 19 of second plank 17).

As shown in FIG. 10, the exterior angle formed by tongue outer edge 74 on the tongued side of the plank and a tongue 75 of a typical hardwood plank 71 may not be a 90 degree angle. The angle D of the angled region formed between tongue outer edge 74 and tongue 75 is normally about 89.5 degrees. Similarly, groove outer edge 70 on the opposite groove side of the plank is at an angle E of about 88.5 degrees in relation to a centerline 71 of the plank 11. As shown in FIG. 11, these angles relieve tongue outer edge 74 and groove outer edge 70 from each other when butted together. This ensures tongue outer edge 74 and groove outer edge 70 will only contact near tongue top edge 72, and groove top edge 73. This ensures that there will be minimal interference between the edges which could create a gap at the top of the joint.

In the use of pneumatic hardwood staplers, knots in the hardwood plank or drops in air pressure may cause the nailer to only partially drive the staple, leaving an undesirable exposed staple head. FIG. 6 illustrates the problem. Hardwood staple 10 has been partially driven into the side of the hardwood plank, leaving an exposed staple head 2. Whenever there is an exposed staple head, the tongue of a first plank and the groove of the next plank will not fit together. The floor installation process comes to a halt.

Presently, hardwood installers normally carry snips and conventional nail sets to hammer down partially driven staples. The staple legs have to be separated from the crown, and then the legs can be driven using a conventional nail set. This is a difficult, time consuming process. If a set tool were available to drive the entire exposed staple head the rest of the way into the side of the plank, it would greatly speed the process of installation. The process of driving a partially driven staple or exposed staple head will be referred to herein as a process of "finish hammering" the hardwood staple.

Tools have been developed for hammering nails into the side of tongue and grooved flooring materials, but none for finish hammering modern hardwood staples from pneumatic staplers. For example, U.S. Pat. No. 1,016,383 to Wellman discloses a set tool with a plate which sits flat on the hardwood plank. The plate includes a "V-rib" or 90 degree internal angle surface formed in its base. The V-rib is shaped to conform to the plank at the exterior angle formed by the outer edge of the plank and the tongue of the plank (also referred to as a "rabbet" as this term is used in woodworking). Thus, the V-rib functions to position the plate at a precise location "to permit the effective drive of nails". A circular "passage" for inserting a round headed nail is formed at a 45 degree angle through the plate to the vertex of the V-rib. Thus, when the point of the nail is inserted into the passage, it is automatically located at the optimal location for driving the nail at a 45 degree angle into the side of the plank.

In addition, the disclosed device of Wellman includes a "punch or driving element" for use in connection with the plate. The punch is a generally cylindrical rod with a reduced outside diameter on one end which can slidably fit within the passage in the plate. This reduced diameter end can slide within the passage all the way to the bottom of the passage, and can thus drive the nail all the way down to the bottom of the passage. Thus, as this disclosure states, "the nail can be entirely driven into the flooring without removing the improved implement" (i.e., the "plate").

Wellman's floor set may have worked well for the purpose of driving nails, but it is not suitable for the purpose of finish-hammering partially driven modern hardwood staples. The reason is that the passages are merely cylindrical holes designed for the passage of round headed nails. In comparison, modern hardwood staples are fairly thin, U-shaped metal wire form products. Effectively driving such staples requires that the staple be precisely supported all the way into the material by means of a precision staple channel that is shaped to create a precision slide fit with the dimensions of the staple. If a user attempted to drive such a staple with only a hammer, the lack of support means would cause the thin metal legs of the staple to bend over or break. The passage of the Wellman device will not provide the necessary precision support means for supporting the staple.

Other known set tools have been developed for driving staples, but they all have drawbacks. U.S. Pat. No. 1,213,334 to Chapman discloses a single-piece driving rod type staple set with a plurality of "sockets" (i.e., "blind-hole" staple channels) of varying depths formed in its driving head. The reference states that "the sockets are made of gradually decreasing depths so as to accommodate the staple at various stages of its entrance into the wood in which it is being set." Thus, the user begins by inserting a staple in the deepest channel, and hammers on the opposite end to start the driving process. Once the driving head contacts the wood, the user inserts the staple head into one of the shallower sockets, and the staple can be driven further. The legs of the staple are supported by the various sockets, preventing them from spreading or bending over. This device is not suitable for the purpose of finish hammering hardwood staples because the plurality of sockets requires a wide head. Such a wide head does not easily enter the exterior angle formed by the outer edge of the plank and the tongue of the plank. Furthermore, modern hardwood staples are by comparison much longer and thinner than the staples shown by Chapman. More sockets of even greater depth would be necessary, and the sockets would need to be thinner. Forming enough thin blind sockets into the head would become impractical. Finally, there is no means to maintain the prescribed 45 degree angle during the finish hammering process. What is needed is a tool with a single staple slot with a length at least as long as the hardwood staple, and a means of driving the head of the hardwood staple down the length of the staple channel. The staple channel could be formed at the prescribed 45 degree angle.

Other similar set tools, such as that disclosed in U.S. Pat. No. D493,079 S to Fowler, have more compact, relieved driving heads which include a single staple socket. Such a compact driving head can more easily enter the exterior angle formed by the outer edge of the plank, and the tongue of the plank. However, there is no means of support for the legs of the staple. This type of tool is not helpful in cases where the staple protrudes a significant distance from the hardwood plank. Without support during the driving process, the staple simply bends over.

What is needed is a set tool for finish hammering modern hardwood staples which properly supports the legs of these staples throughout the process of finish hammering while also maintaining the prescribed 45 degree angle and location on the plank where such staples are normally driven.

SUMMARY

A stapling tool, for stapling hardwood tongue and groove flooring planks into a subfloor surface, is herein described. The stapling tool has a body and a rod assembly.

The body includes a body base surface, a stop surface extending at an angle from the body base surface, and a body top surface. The body further includes a staple slot. The staple slot is configured to guide a hardwood flooring staple from a first opening or a staple slot staple insertion point in the body top surface to a second opening or a staple slot staple exit point of the body. The staple slot staple exit point of the body or a staple insertion edge is insertable within an external angle of the hardwood flooring plank as the body base surface rests on the top face of the plank. The external angle is formed by a tongue and an outside edge of the hardwood flooring plank.

The rod assembly includes a hammering head and a staple driving head. The hammering head is configured to receive an impact force from a head of a hammer. The staple driving head is operatively coupled to the hammering head. The staple driving head is configured to transfer the impact force to the hardwood flooring staple.

In order to drive the hardwood flooring staple into the hardwood flooring plank, the hardwood flooring staple is inserted into the staple slot staple insertion point. After the insertion of the hardwood flooring staple, followed by the staple driving head, the staple is guided by the staple slot. The staple is drivable into the hardwood flooring plank at the external angle by the staple driving head, in response to the impact force received by the hammering head and transferred to the staple driving head.

The hardwood flooring staple may be inserted into the staple slot staple insertion point from beyond a plane defined by the body top surface. The staple slot may be at an angle greater than 45 degrees and less than or equal to 85 degrees in relation to a plane of the body base surface.

A staple driving assembly may include the hammering head, a staple driver and a rod body. The rod body is insertable to a rod hole of the body at a rod hole opening of the body top surface. The rod body is guided by the rod hole. The staple driver is coupled to the hammering head. The staple driver is insertable to the staple slot. The staple driver is guided by the staple slot. The staple driver is configured to transfer the impact force to the hardwood flooring staple.

DETAILED DESCRIPTION

Figure 1:
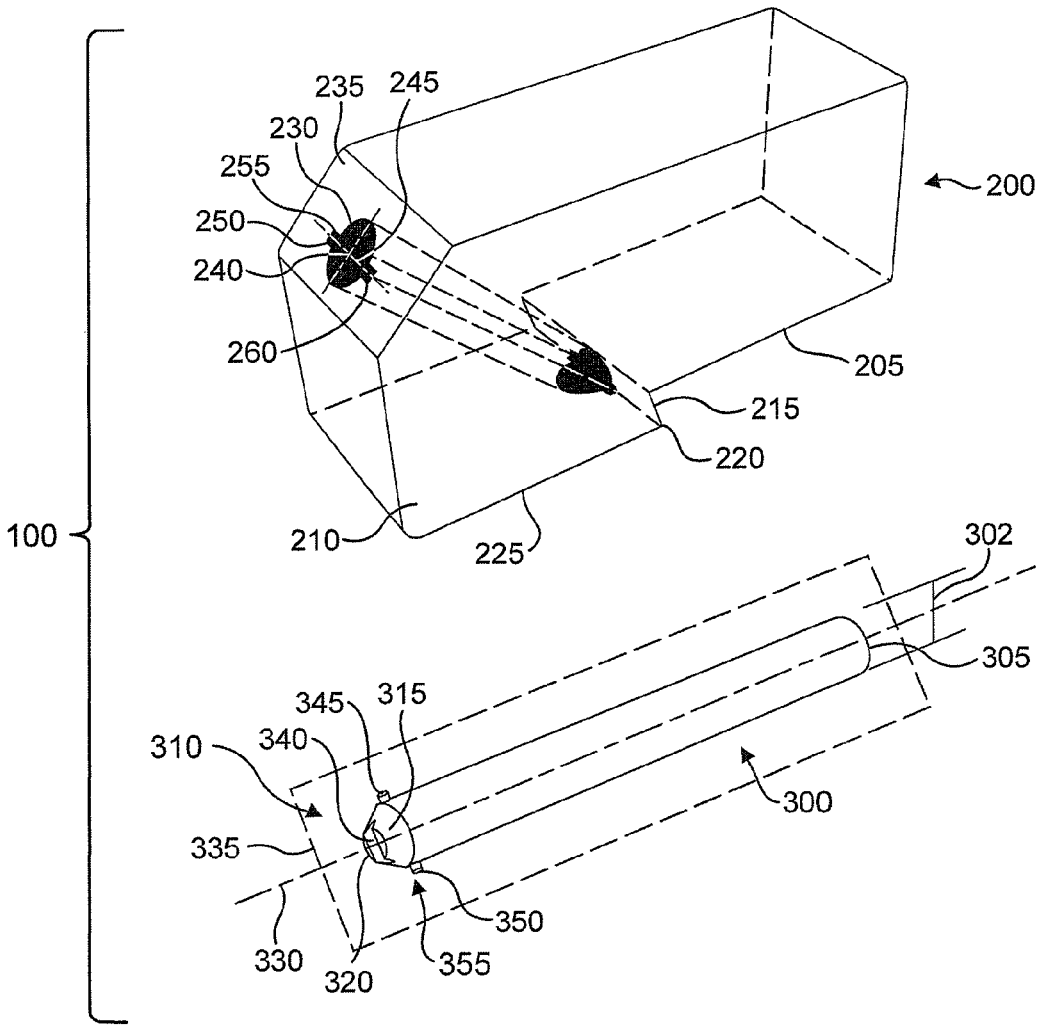
FIG. 1 is a disassembled perspective view of the set tool showing the body and the driving rod.
Figure 2:
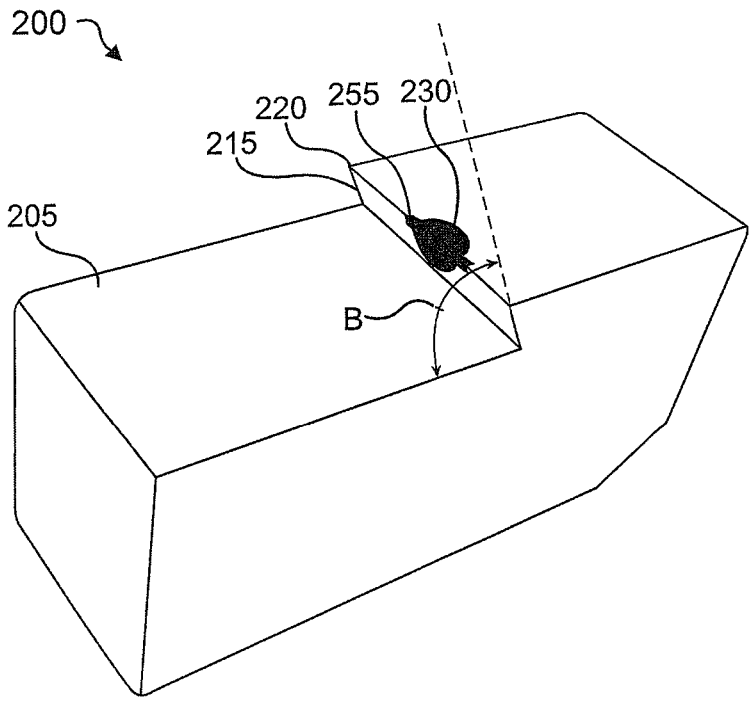
FIG. 2 is a bottom perspective view of the set tool body.
Figure 7:
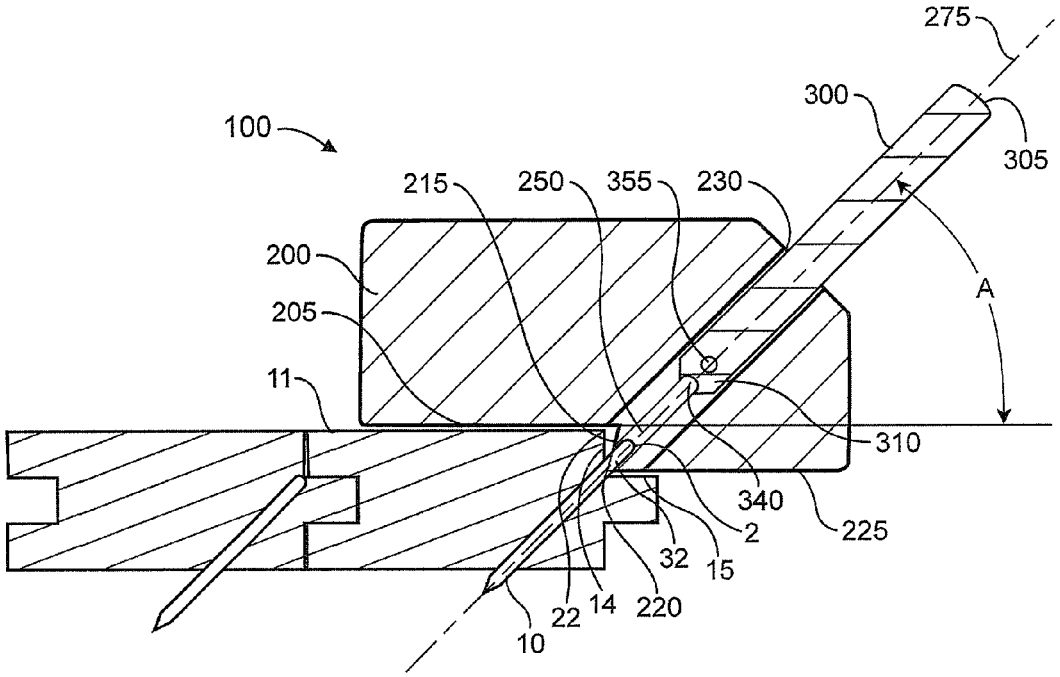
FIG. 7 is a vertical cross section of the set tool bisecting the 45 degree angle hole to show the insertion of an exposed staple head.

As shown in FIG. 1, set tool 100 includes a block-like body 200 and a rod 300. Body 200 includes a flat body base surface 205 for setting body 200 flat on the face of a hardwood plank, and an arm 210 extending downward to form a stop surface 215. As shown in FIG. 2, a bottom view of body 200, stop surface 215 forms an external angle B in relation to body base surface 205. Angle B could be any angle in the area of 90 degrees corresponding roughly to the shape of the external angle formed by outside edge of the hardwood plank, and the tongue of the plank (approximately 89.5 degrees). However, it is preferred that this angle B be about 75 degrees. As shown in FIG. 7, such an angle causes stop surface 215 to be slightly relieved from outer edge 14 and top edge 22 of a plank. This ensures that when the outer edge of the hardwood plank is placed up next to stop surface 215, stop surface 215 will not contact the top edge 22 of the plank 11. This prevents the top edge of the hardwood plank from being chipped by impacts from the body.

As shown in FIG. 1, arm base surface 225 intersects stop surface 215 to form a staple insertion edge 220. Arm base surface 225 is parallel to body base surface 205. As shown in FIG. 7, the angled extension of stop surface 215 places a staple insertion edge 220 precisely at the vertex of the external angle formed by the outer edge 14 of the plank, and the tongue 15 of the plank. This is precisely the point in the plank from which that an exposed staple head normally extends.

The vertex of the external angle is at the junction of the outer edge 14 of the plank and the tongue 15 of the plank. This external angle is in a region external to the material of the hardwood flooring plank itself. Thus, the staple insertion edge 220 is dimensioned to fit into the angled region formed by the outer edge 14 of the plank and the tongue 15 of the plank.

As shown in FIG. 1, a 45 degree hole 230 is formed extending from top surface 235 in body 200 through to staple insertion edge 220. As used herein, the measurement of angle of 45 degrees used to describe 45 degree hole 230 is illustrated in FIG. 7. The angle A formed by the plane formed by body base surface 205 and a centerline 275 of 45 degree hole 230 is about 45 degrees.

As shown in FIG. 1, 45 degree hole 230 is a round hole. 45 degree hole 230 has a center 240. Center 240 forms one end of a centerline of 45 degree hole 230 that extends downward at an angle of 45 degrees and ends precisely at staple insertion edge 220. Thus, when viewed from center 240, 45 degree angle hole 230 is bisected by a 45 degree plane extending upwards from the line formed by staple insertion edge 220 to center 240. Also in this plane is a "bisecting diameter" 245 of 45 degree hole 230. The plane between staple insertion edge 220 through bisecting diameter 245 (and through center 240) will be referred to herein as the "45 degree bisecting plane" of hole 230.

The shape of 45 degree hole 230 could be any shape, including, at a minimum, a rectangular shape having a slightly greater width and thickness to permit a precise slide fit with an exposed head of a typical hardwood staple. However, a round hole is preferred so that it may be formed using a standard drill. 45 degree hole 230 is sized to accommodate a cylindrical rod 300 having a hammering head 305 with a thickness 302 greater than that of the thickness of a typical hardwood staple. A thicker hammering head 305 is preferred because it is easier to strike and will not bend as easily as a rod that was only the thickness of a typical hardwood staple. However, 45 degree hole 230 (and rod 300) are preferably not wider than the width of a typical hardwood staple. This is so a staple slot 250 can be formed by the addition of two parallel rectangular channels 255, 260. Channels 255, 260 have a precise width and thickness such that they together form a rectangular staple slot 250. The shape of staple slot 250 creates a precise slide fit to accept and support an exposed staple head during the process of finish hammering.

Channels 255, 260 have their center on the same center 240 as 45 degree hole 230 and are thus bisected by the same 45 degree bisecting plane. Channels 255, 260 are formed in 45 degree angle hole 230 all the way down to staple insertion edge 220. Thus, channels 255, 260 and staple slot 250 are also bisected by the line formed by staple insertion edge 220. As more clearly shown in FIG. 2, a bottom view, 45 degree angle hole 230 and staple slot 255 are both bisected by the line formed by staple insertion edge 220, placing the staple slot at the optimal location for receiving an exposed hardwood staple head.

Figure 3:
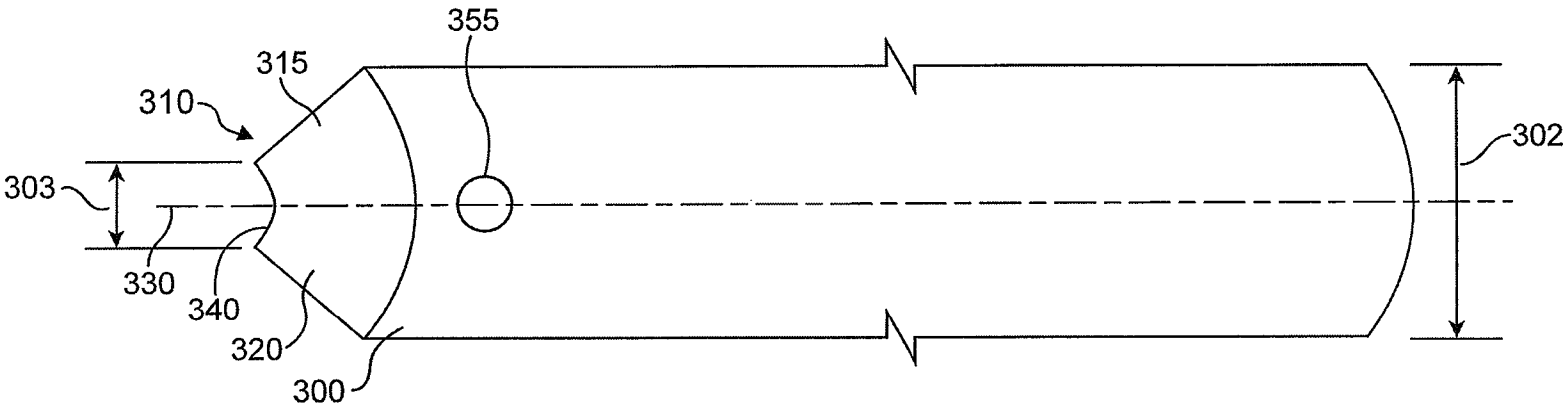
FIG. 3 is a detailed side view of the rod.

As shown in FIG. 1, set tool 100 includes a cylindrical rod 300 with an outside diameter 302 that slides within the 45 degree angle hole 230. Rod 300 has a centerline 330 and is bisected by a plane 335 through a diameter of rod 300. Rod 300 has a hammering head 305 on one end, and a staple driving head 310 on its opposite end. Staple driving head 310 has relieved edges 315, 320. As shown in greater detail in FIG. 3, relieved edges 315, 320 form an included angle in the area of 75-90 degrees. The vertex of this included angle is centered on centerline 330 of rod 300. Relieved edges 315, 320 allow staple driving head 310 to enter the external angle formed by the outer edge of the hardwood plank, and the tongue of the plank. As shown in FIG. 1, a staple receiving groove 340 is formed in driving head 310 for receiving an exposed staple head. As shown in FIG. 3, staple receiving groove 340 is bisected by centerline 330. As shown in FIG. 1, staple receiving groove 340 is also bisected by plane 335.

As previously explained, the thickness of rod 300 is greater than the thickness of a typical hardwood staple. As shown in FIG. 3, the full thickness 302 of rod 300 is greater than the thickness of a typical hardwood staple. The thickness of the staple is approximately represented by staple receiving groove 340 (dimension 303).

As shown in FIG. 1, near staple driving end 310 are two guide nubs 345, 350. Guide nubs 345, 350 are formed by insertion of a cylindrical pin 355 through a hole just behind staple receiving groove 340. As shown in FIG. 3, cylindrical pin 355 is centered on and bisected by the same centerline 330 as staple receiving groove 340. Thus, as shown in FIG. 1, pin 355 and guide nubs 345, 350 will also be bisected by plane 335.

Figure 4:
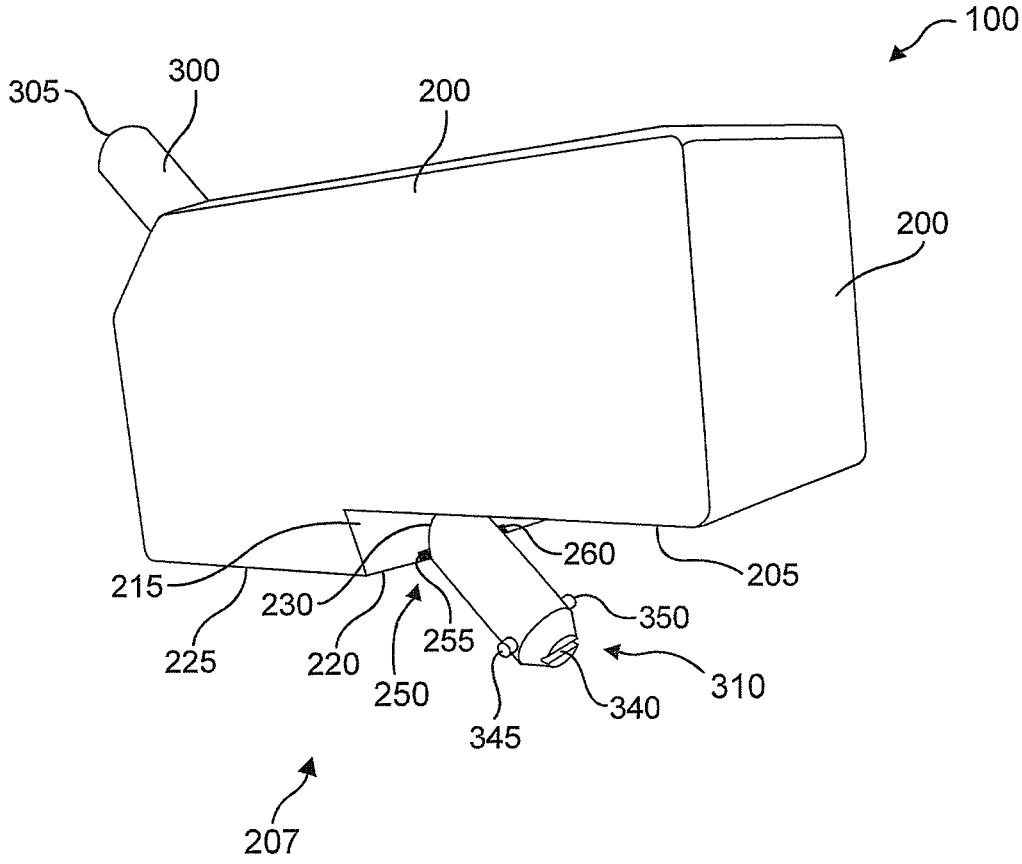
FIG. 4 is an assembled view of the set tool.
Figure 5:
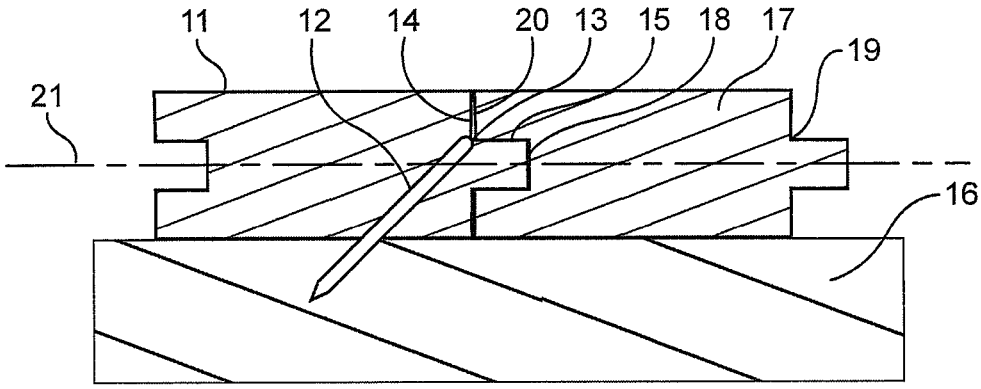
FIG. 5 is a cross-sectional view of a hardwood plank showing a properly driven hardwood staple.
Figure 6:
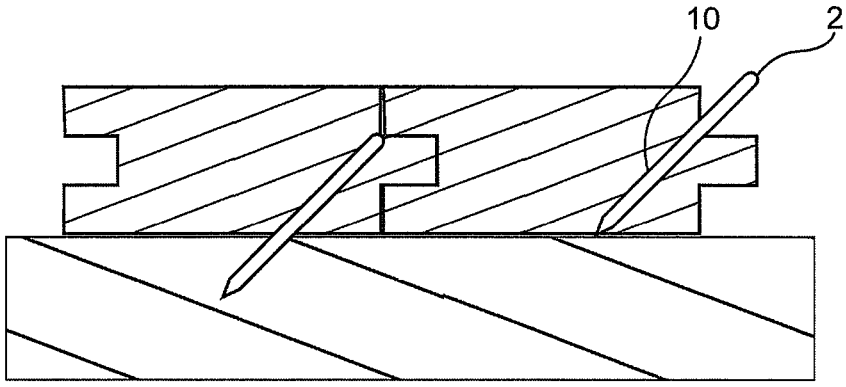
FIG. 6 is a cross-sectional view of an exposed staple head in a hardwood plank.

As shown in FIG. 4, when set tool 100 is assembled, rod 300 is slidably inserted into 45 degree hole 230 in body 200. Guide nubs 345, 350 extend from rod 300 such that they may enter the two channels 255, 260 forming staple slot 250 inside 45 degree hole 230. The staple driving end 310 of rod 300 is guided by guide nubs 345, 350 to the exposed head of the hardwood staple. Staple receiving groove 340 of staple driving end 310 fits over the exposed hardwood staple head, forming a supportive driving surface. Body 200 has a body base surface 205. Extending downward from body base surface 205 is arm 225. Arm 225 forms a stop surface 215. Stop surface 215 forms an external angle of about 75 degrees in relation to body base surface 205. Staple insertion edge 220 is located at the bottom of stop surface 215. Arm base surface 225 is parallel to body base surface 205.

FIG. 7 is a cross sectional view of the set tool properly located over an exposed staple head and against the edge of a hardwood plank. Hardwood staple 10 is partially driven into the side of the plank 11, leaving an exposed staple head 2. To position set tool 100, the user first puts exposed staple head 2 into staple slot 250. The user rests body 200 on a top face of plank 11 on body base surface 205, and presses staple insertion edge 215 of body 200 into the vertex of the external angle formed by the outer edge 14 of the plank, and the tongue 15 of the plank. Arm base surface 225 rests on the tongue 15 of plank 11. Rod 300 is inserted into 45 degree hole 230 with the two guide nubs formed by pin 355 inserted into the two channels forming staple slot 250. Thus, staple receiving groove 340 in the staple driving end 310 of rod 300 is guided to exposed staple head 2. Once the staple receiving groove 340 contacts exposed staple head 2, the user hammers on hammering end 305, and the exposed staple head 2 is finished hammered into the side of plank 11. The exposed staple head will not bend over due to close support provided by the staple slot 250.

A number of alternatives may be adopted to create a plank top set tool for hardwood staples. As previously explained, it is preferred that the rod for finish hammering the staple be thicker than the thickness of the hardwood staple, in order to allow for easy hammering. However, in other alternatives, the thickness of the rod need only be about as thick as a hardwood staple. As also previously explained, for efficient manufacturing, it is preferred that the 45 degree angle hole be circular so that it could be machined using standard drills, and for the rod to be cylindrical. However, the 45 degree angle hole could be formed in a different shape, such as a triangle or square, and have a rod of corresponding shape. The use of a square or triangular 45 degree angle hole and corresponding rod would prevent the rod from rotating within the hole, thus eliminating the need for guide nubs and a staple slot running the full length of the 45 degree angle hole.

Figure 9:
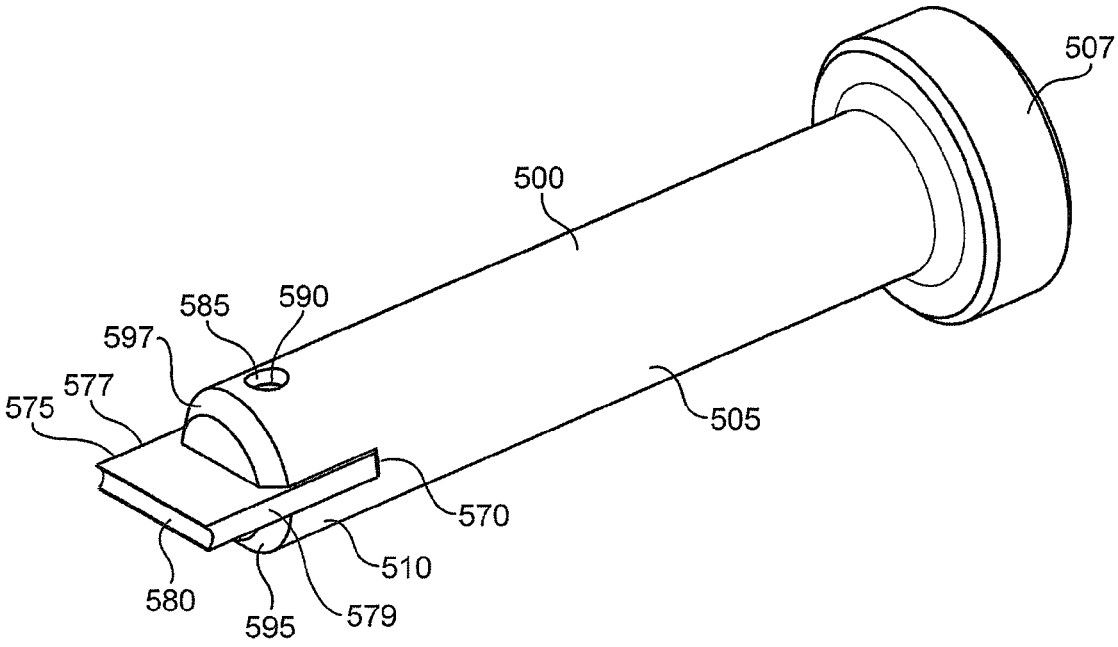
FIG. 9 is a perspective view of an alternative rod for the set tool having a thin metal tip.
Figure 10:
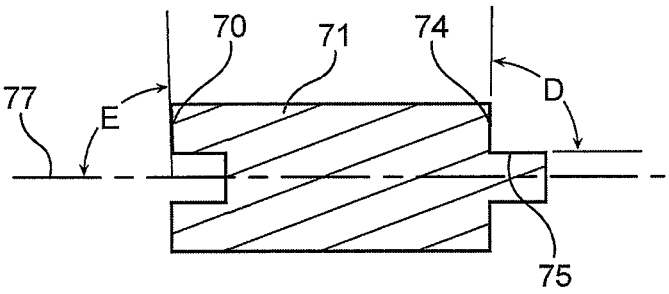
FIG. 10 is a cross section of a hardwood plank showing the angles formed by the outer edge of the plank on both the tongued side and the grooved side of the plank.
Figure 11:
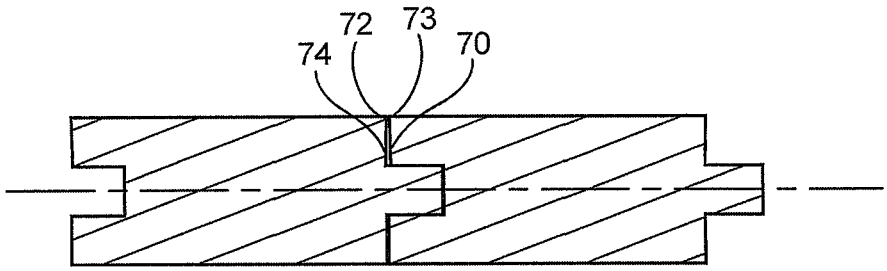
FIG. 11 is a cross section of two hardwood planks showing how the angles formed by the relieved outer edges on both the tongue and grooved sides the plank interact to prevent a gap from forming between the planks.

In a preferred embodiment, the rod includes a staple driving head having relieved edges forming an included angle shape, and an integral staple receiving groove formed in the relieved end. This configuration is preferred due to low manufacturing cost due to minimal parts. In another alternative, the set tool could include a staple driving head with a thin tip extension. As shown in FIG. 9, rod 500 has a staple driving head 510 that includes a slot 570. Inserted into slot 570 is a tip 575 that could be formed as a metal stamping from a thin piece of metal. Tip 575 has a staple receiving groove 580 formed in its end. Tip 575 is fastened to rod 500 by press fitting a pin 590 into a hole 585. Tip edges 577, 579 may form guide nubs running within a staple slot to guide the tip 575 to the top of the exposed hardwood staple head. In the finish hammering process, tip 575 is thin and easily enters the external angle formed by the outside edge of the hardwood plank, and the tongue of the plank. However, relieved edges 595, 597 in staple driving end 510 are still needed to allow the whole staple driving end to enter this external angle formed by the outer edge of the plank, and the tongue of the plank.

A thin tip such as tip 575 can have several advantages if a higher priced, more durable, and more functional set tool is desired. Rod 500 can be formed as a body 505 from a first, comparatively soft material having sufficient impact resistance for safe hammering at hammering end 507. Tip 575 may be made from a harder material which could be precision ground on the end to form a staple receiving groove 580 that conforms with the longitudinally rounded shape of the crown of the hardwood staple. Tip 575 can better drive the exposed hardwood staple head below flush into the side of hardwood plank. The lack of any exposed hardwood staple head whatsoever at the tongue and groove joint can make it easier to get the joint between planks together.

In another alternative, the rod of the set tool could incorporate a means to protect the hand from off center blows from a hammer.

In another alternative, the body of the set tool could incorporate a prying means for standing up accidentally bent over staples, or prying them out if necessary.

In another alternative, a felt pad may be added to the body base surface of the body to protect the face of the hardwood plank from being scratched.

The embodiments may be characterized in a number of different ways. For example, the device may be sold as a complete set tool, including both a body and a rod. Alternatively, the body and rod may be sold separately, requiring final assembly by a user.

In another embodiment, the staple slot may be configured at an angle of about 65 degrees in relation to a plane defined by the body base surface used to rest the tool on a top face of a hardwood flooring plank. In variations, an angle greater than 45 degrees and less than or equal to 85 degrees may be used for the staple slot. By contrast, at least one existing automatic hardwood flooring stapler is configured with a staple slot at a 45 degree angle to the corresponding body base surface.

In another embodiment, the rod element may include additional elements, which will be referred to herein as a "rod assembly". The elements of the rod assembly include a hammering head, a staple driver attached to the hammering head, and a rod body.

These embodiments, each or in various combinations, could produce a stapling tool capable of driving hardwood flooring staples at an angle into the side of a hardwood flooring plank at a closer distance from a wall surface than prior art automatic staplers. The bulky driver housings and 45 degree configuration of prior art automatic staplers prevents them from stapling planks in close proximity to walls.

The alternatives to stapling planks have drawbacks. Such alternatives include gluing the hardwood plank to the subfloor, or top nailing the plank (through the top face of the plank) into the subfloor. Gluing requires an expensive adhesive, which is preferred to be used as little as possible. Top nailing the hardwood plank requires expensive touch-up puttying labor to conceal the unsightly nail heads buried in the top face of the plank.

A stapling tool capable of driving a hardwood flooring staple into the side of a hardwood flooring plank in closer proximity to a wall surface would reduce the need for gluing or top nailing.

Figure 12:
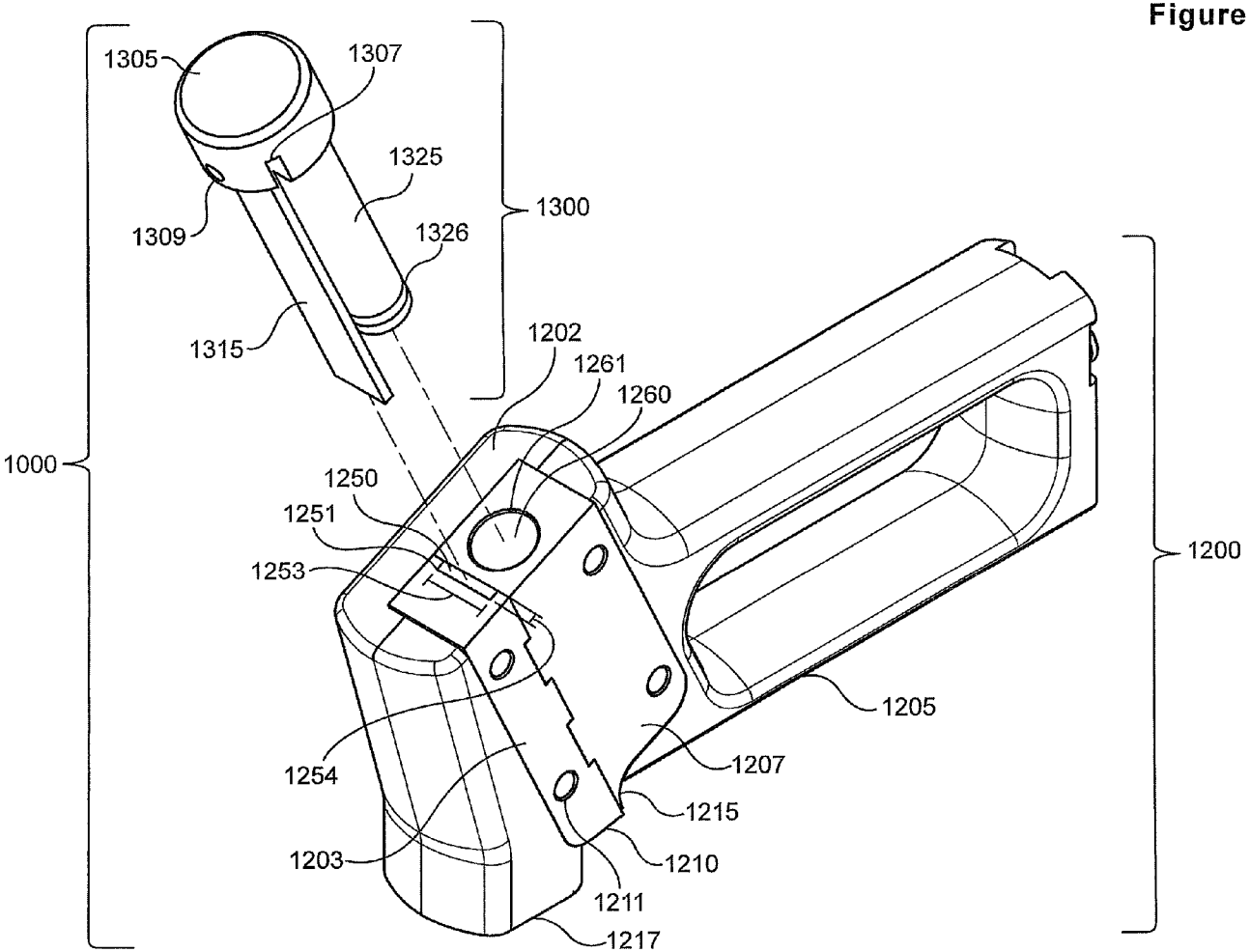
FIG. 12 is a perspective view of a stapling tool that is a variation of the set tool of FIG. 1.

As shown in FIG. 12, stapling tool 1000 includes a body 1200 and a rod assembly 1300. Body 1200 includes a flat body base surface 1205 for setting body 1200 flat on the face of a hardwood plank. An arm 1210 extends downward from body base surface 1205. The profile of arm 1210 includes an outer surface that will be referred to as stop surface 1215.

Figure 13:
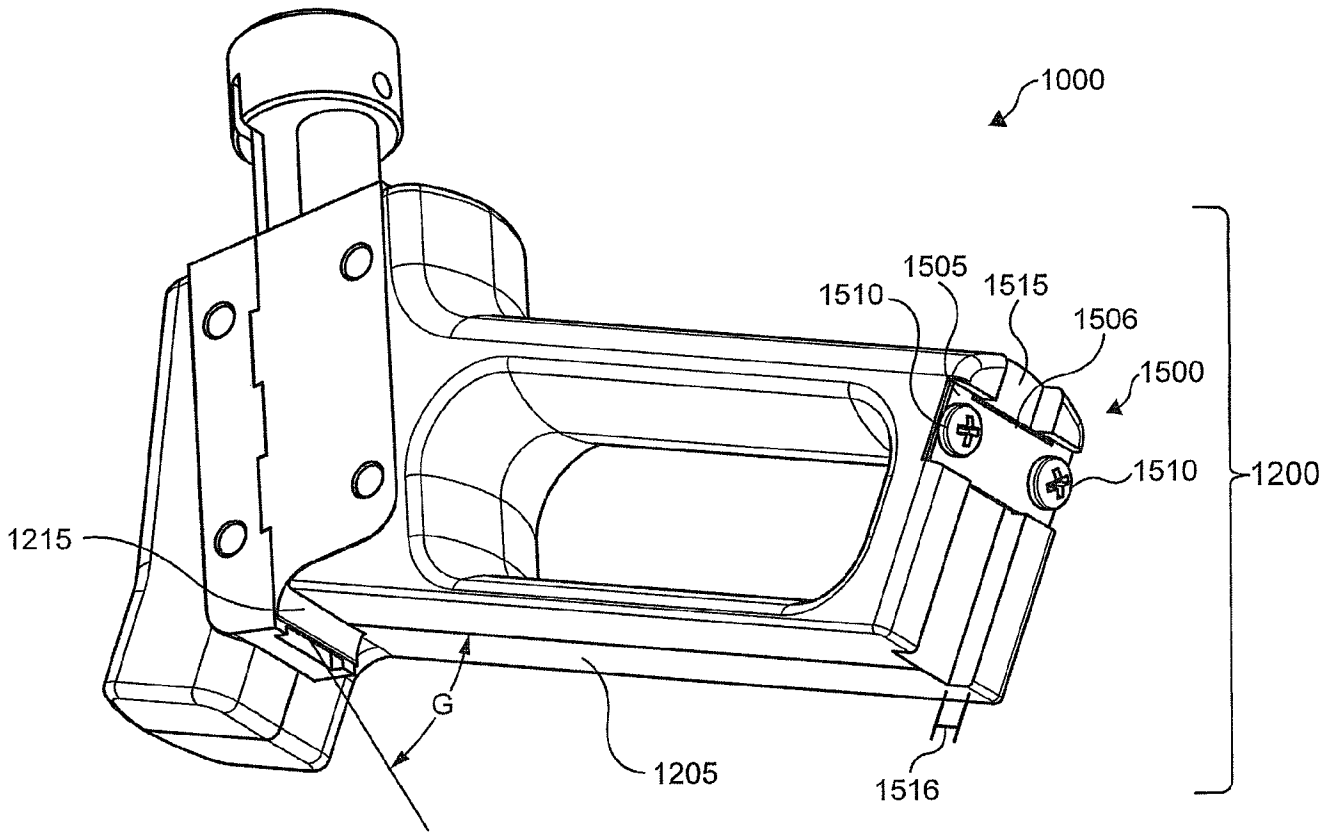
FIG. 13 is a further perspective view of the stapling tool of FIG. 12, showing a body base surface and a staple separator.

FIG. 13 better illustrates the relation of stop surface 1215 to body base surface 1205. Stop surface 1215 forms an angle G in relation to body base surface 1205 of about 75 degrees.

Figure 14:
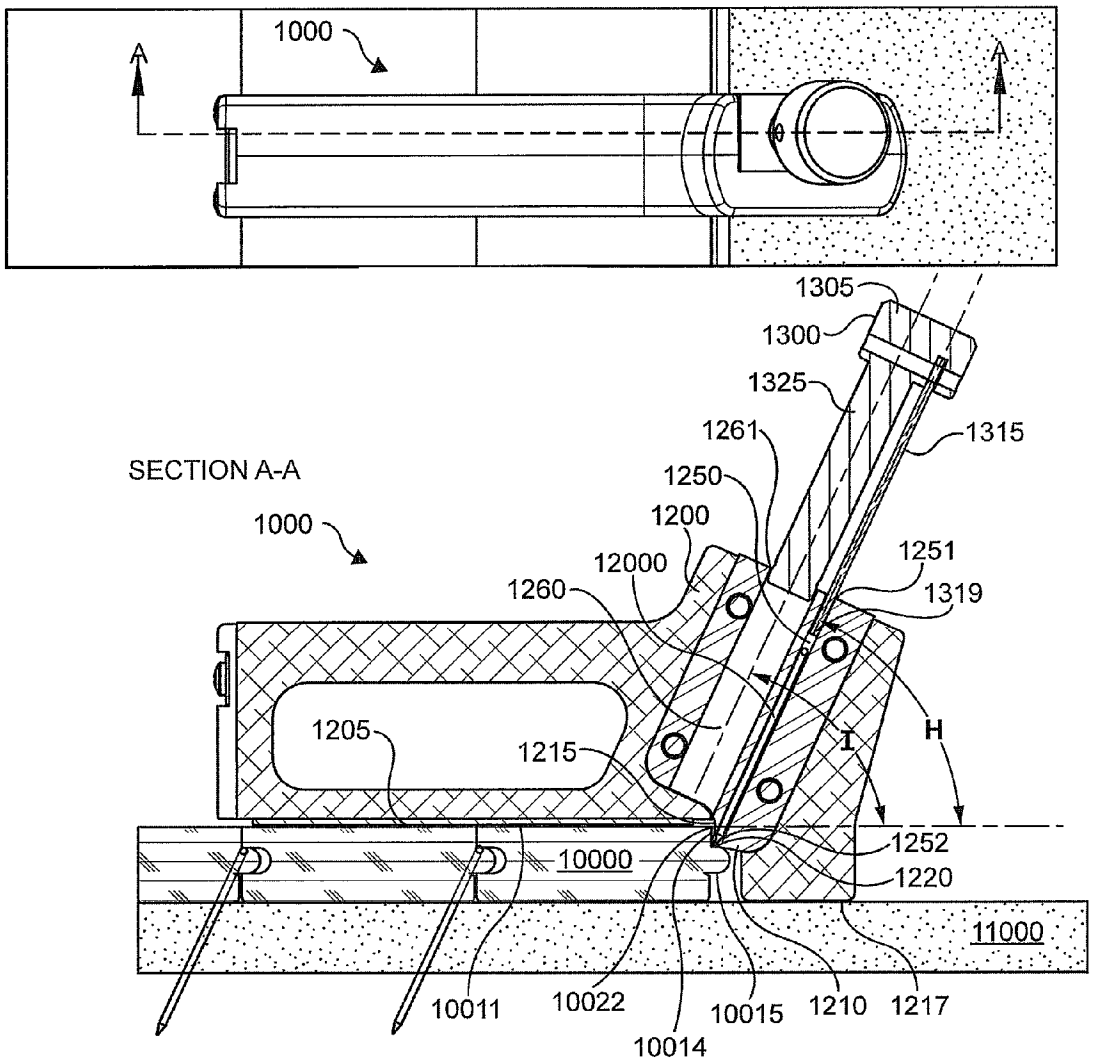
FIG. 14 is a cross-section view of the stapling tool of FIG. 12.

FIG. 14 shows stapling tool 1000 in use on top of several hardwood flooring planks, including a section view A-A. From this view it can be seen that 75 degree angle of stop surface 1215 makes stop surface 1215 slightly relieved from a top edge 10022 of a plank 10000. This prevents stop surface 1215 from contacting the top edge 10022 of plank 10000 during the staple driving process, which could cause chipping.

Besides body base surface 1205, the body 1200 further includes foot 1217 for locating stapling tool 1000 in proper position. As shown in Section A-A FIG. 14, with the tool in proper position, foot 1217 rests on the subfloor 11000. Support provided by foot 1217 prevents the top of tongue 10015 from being damaged by impacts from arm 1210 during the hammering process.

Figure 15:
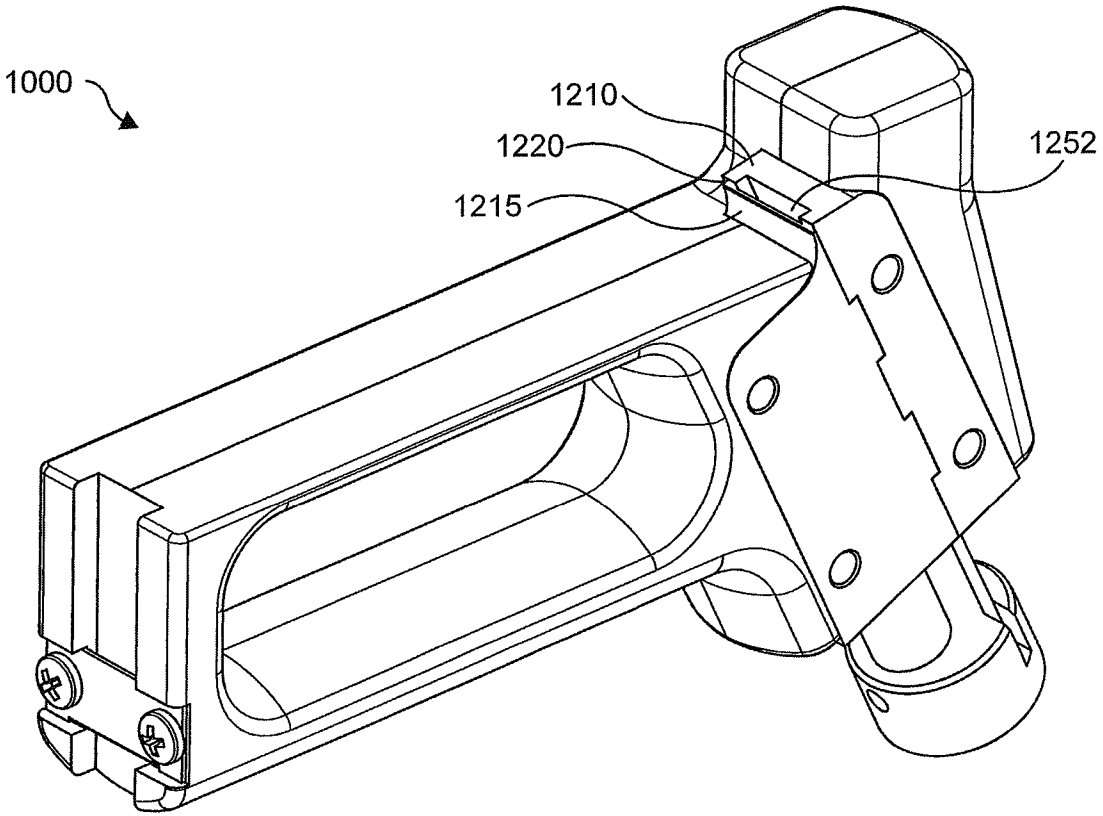
FIG. 15 is a bottom perspective view of the stapling tool of FIG. 12, showing the bottom staple slot opening.

FIGS. 12, 14 and 15 show a staple slot, through which a staple may slide. As shown in FIG. 12, body 1200 includes top surface 1201 which includes several features. The staple slot 1250 has a top staple slot opening 1251. As shown in Section A-A of FIG. 14, staple slot 1250 opens at top staple slot opening 1251, and runs to a bottom staple slot opening 1252 at a staple insertion edge 1220. As better shown in FIG. 15, bottom staple slot opening 1252 opens at staple insertion edge 1220.

As used herein, and as shown in Section A-A of FIG. 14, top staple slot opening 1251 forms a staple slot staple insertion point for staple slot 1250. A hardwood flooring staple is inserted into staple slot 1250 at the staple slot staple insertion point formed by top staple slot opening 1251. In one variation, the body includes a body top surface within a recess, such as a blind hole. The staple slot staple insertion point is located within the opening in the body top surface.

As shown in Section A-A of FIG. 14, when stapling tool 1000 is placed with stop surface 1215 against an outer edge 10014 of the plank, bottom staple slot opening 1252 and staple insertion edge 1220 locates in close proximity to the vertex of the external angle formed by the outer edge 10014 of the hardwood plank, and the tongue 10015 of the plank. This is the point at which a hardwood flooring staple should be driven into the plank.

As used herein and as shown in FIG. 15, bottom staple slot opening 1252 will be referred to as a staple slot staple exit point. A hardwood flooring staple is inserted at the aforementioned staple slot staple insertion point (formed by top staple slot opening 1251), and is drivable down the length of the staple slot until it exits at the staple slot staple exit point formed by bottom staple slot opening 1252.

As shown in Section A-A of FIG. 14, a centerline of staple slot 1250 forms an angle H with a plane of body base surface 1205. As will be explained below in a section describing use of stapling tool 1000, angle H is preferred to be about 65 degrees.

Figure 8:
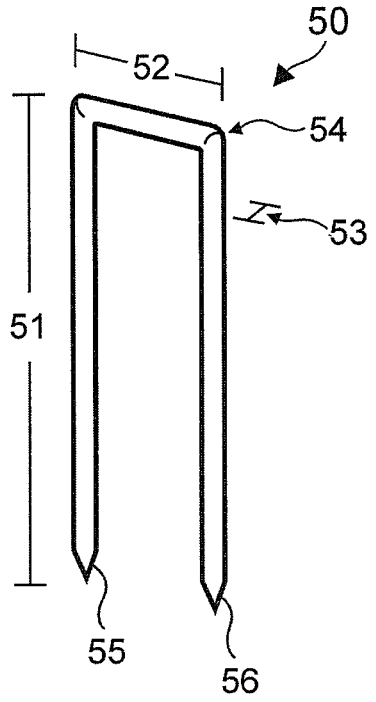
FIG. 8 is a perspective view of a typical hardwood staple.

As shown in FIG. 12, staple slot 1250 has a width 1253 and a thickness 1254. Staple slot width 1253 is sized for slide fit insertion of width 52 of hardwood flooring staple 50 (FIG. 8). Staple slot thickness 1254 is sized for slide fit insertion of thickness 53 of a hardwood flooring staple 50, shown in FIG. 8.

Figure 21:
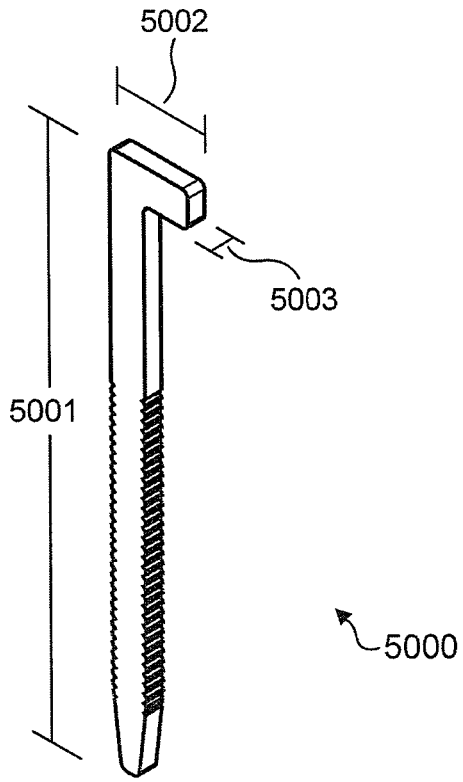
FIG. 21 is a perspective view of a cleat that may be used in a variation of the stapling tool of FIG. 12.

As shown in FIG. 12, staple slot thickness 1254 is also sized for slide fit insertion of a thickness of other common hardwood flooring staples, such as the thickness 5003 of cleat 5000, which is shown in FIG. 21. Furthermore, the length of staple slot 1250, as more clearly shown in Section A-A of FIG. 14, can accommodate a length 5001 and a width 5002 of cleat 5000, shown in FIG. 21. As used herein, the term hardwood flooring staple includes cleats such as cleat 5000.

To explain how staple slot 1250 is formed in one embodiment, FIG. 12 shows that body 1200 includes left insert 1203 and right insert 1207. Left insert 1203 and right insert 1207 are fastened to body 1200 by four fasteners 1211.

Figure 16:
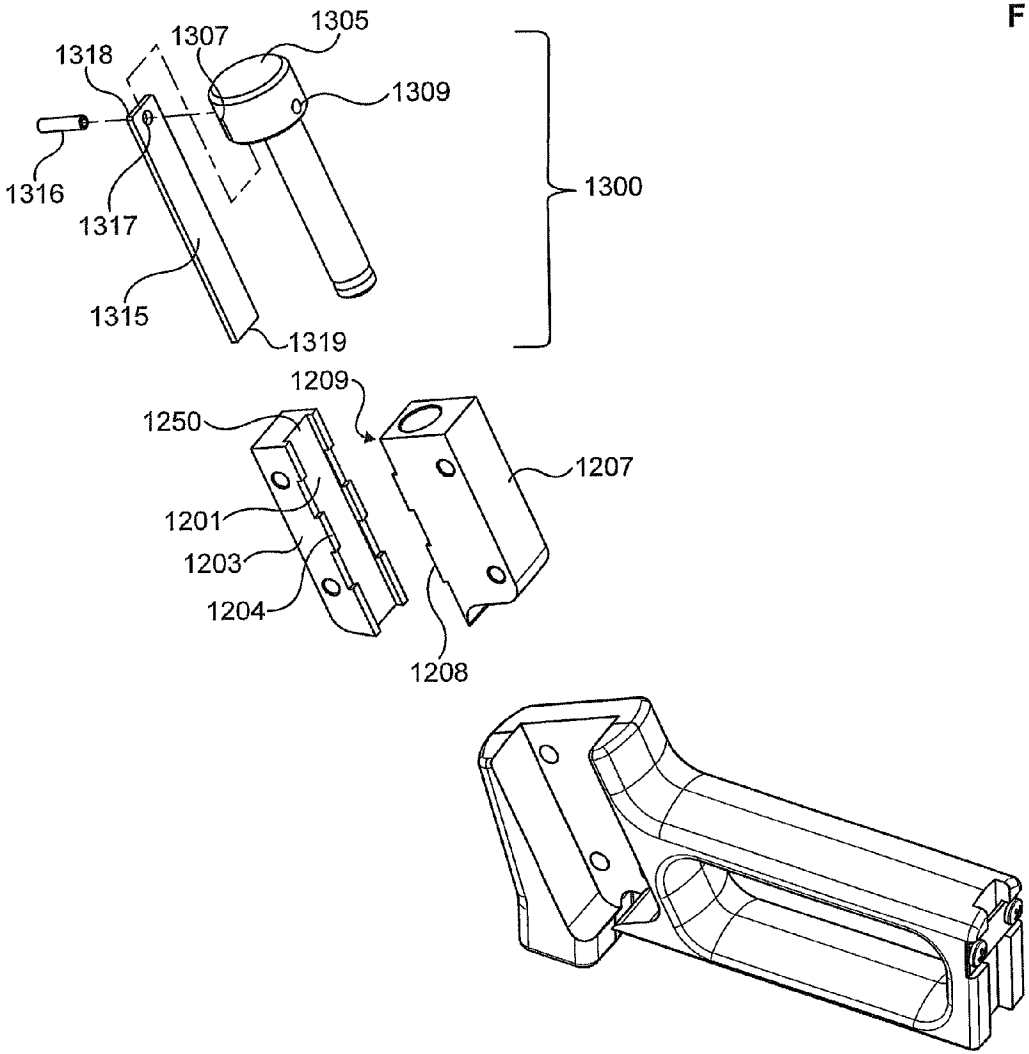
FIG. 16 is a perspective exploded view of the stapling tool of FIG. 12.

As shown in FIG. 16, left insert 1203 and right insert 1207 interlock once assembled to form staple slot 1250. Left insert 1203 has a pair of toothed surfaces 1204. Right insert 1207 has a pair of toothed surfaces 1208 which interlock with the pair of toothed surfaces 1204 of left insert 1203.

In this manner of assembly, the interlocking toothed surfaces 1204 and 1208 form opposing first left and second right surfaces defining a staple slot width. As shown in FIG. 12, these are the left and right inside wall surfaces defining staple slot 1250 and dimensioned as staple slot width 1253.

Furthermore, referring again to FIG. 16, an inner face 1201 of left insert 1203, along with an opposing inner face 1209 of right insert 1207, form opposing third bottom and fourth top surfaces defining a staple slot thickness. As shown in FIG. 12, these are the top and bottom inside wall surfaces defining staple slot 1250 and dimensioned as staple slot thickness 1254.

As shown in FIG. 12, body top surface 1202 additionally includes a rod body hole 1260 having a top rod body hole opening 1261. As shown in Section A-A of FIG. 14, rod body hole 1260 has a centerline that forms an angle I of about 65 degrees with a plane of body base surface 1205. Therefore angle H of staple slot 1250, and angle I of rod body hole 1260, are both 65 degrees, and the centerlines of these features are parallel. The rod body hole 1260 and the staple slot 1250 are in spaced apart parallel arrangement, as are the respective centerlines.

As shown in FIGS. 12, 14 and 16, rod assembly 1300 includes a hammering head 1305, a staple driver 1315, and a rod body 1325. Hammering head 1305 includes a slot 1307 for receiving an end of staple driver 1315, and a pin receiving hole 1309.

As shown in the exploded view of FIG. 16, staple driver 1315 includes a hammering end 1318 and a staple driving end 1319. The hammering end 1318 is insertable into slot 1307 of hammering head 1305. Afterwards, a pin 1316 is press fit into hole 1309 and through a hole 1317 in staple driver 1315.

Pin 1316 holds staple driver 1315 on hammering head 1305 with some degree of play. The play exists because pin 1316 has a smaller outside diameter than the hole 1317 of staple driver 1315. This play allows hammering end 1318 of staple driver 1315 to contact the top of slot 1307 to transfer impact in the driving process.

As shown in FIG. 12, the assembled rod assembly 1300 is inserted to body 1200 with rod body 1325 entering at rod body hole 1260, and staple driver 1315 entering at staple slot 1250. The rod body 1325 and the rod hole 1260 may have close-fitting, complementary circular cross-sections, or other cross-sections may be used. The rod assembly 1300 is cooperatively guided and prevented from rotating by the rod body hole 1325 and the staple slot 1250.

In use, as shown in Section A-A of FIG. 14, stapling tool 1000 is placed on top of a plank 10000 to be stapled. A body base surface 1205 of stapling tool 1000 rests on a top face 10011 of plank 10000. Stop surface 1215 rests against an outer edge 10014 of plank 10000. A foot 1217 rests on a subfloor 11000.

Driver assembly 1300 is removed from staple slot 1250 and rod body hole 1260. A hardwood flooring staple 12000 is inserted into top staple slot opening 1251. Hardwood flooring staple 12000 slides down staple slot 1250 until it reaches bottom staple slot opening 1252 at staple insertion edge 1220. At this location, hardwood flooring staple 12000 is in position to be driven into hardwood flooring plank 10000, with precision support on all sides from staple slot 1250.

After hardwood flooring staple 12000 is inserted into staple slot 1250, a staple driving end 1319 of staple driver 1315 of rod assembly 1300 is inserted at top staple slot opening 1251. Rod body 1325 is inserted into a rod body hole 1260 at top rod body hole opening 1261. As rod assembly 1300 is further fed into staple slot 1250, staple driving end 1319 of staple driver 1315 comes into contact with the top of hardwood flooring staple 12000. At this point, hammering head 1305 is impacted with a hammer, and hardwood flooring staple 12000 will be driven until it is flush within the external angle formed by an outer edge 10014 and the tongue 10015 of plank 10000.

Staple driver 1315 is formed from a thin strip of material that is insertable within staple slot 1250. Staple driver 1315 is preferably made from fully hardened steel to withstand repeated, concentrated impact with the crown of hardwood flooring staple 12000. Rod body 1325 is comparatively thicker and insertable into a large rod body hole 1260. The primary function of rod body 1325 is to prevent bending of the thinner staple driver 1315 in the staple driving process. Rod body 1325 and the hammering head 1305 may be formed from a single and separate piece of material from staple driver 1315, preferably softer and tougher for repetitive hammering.

Figure 17:
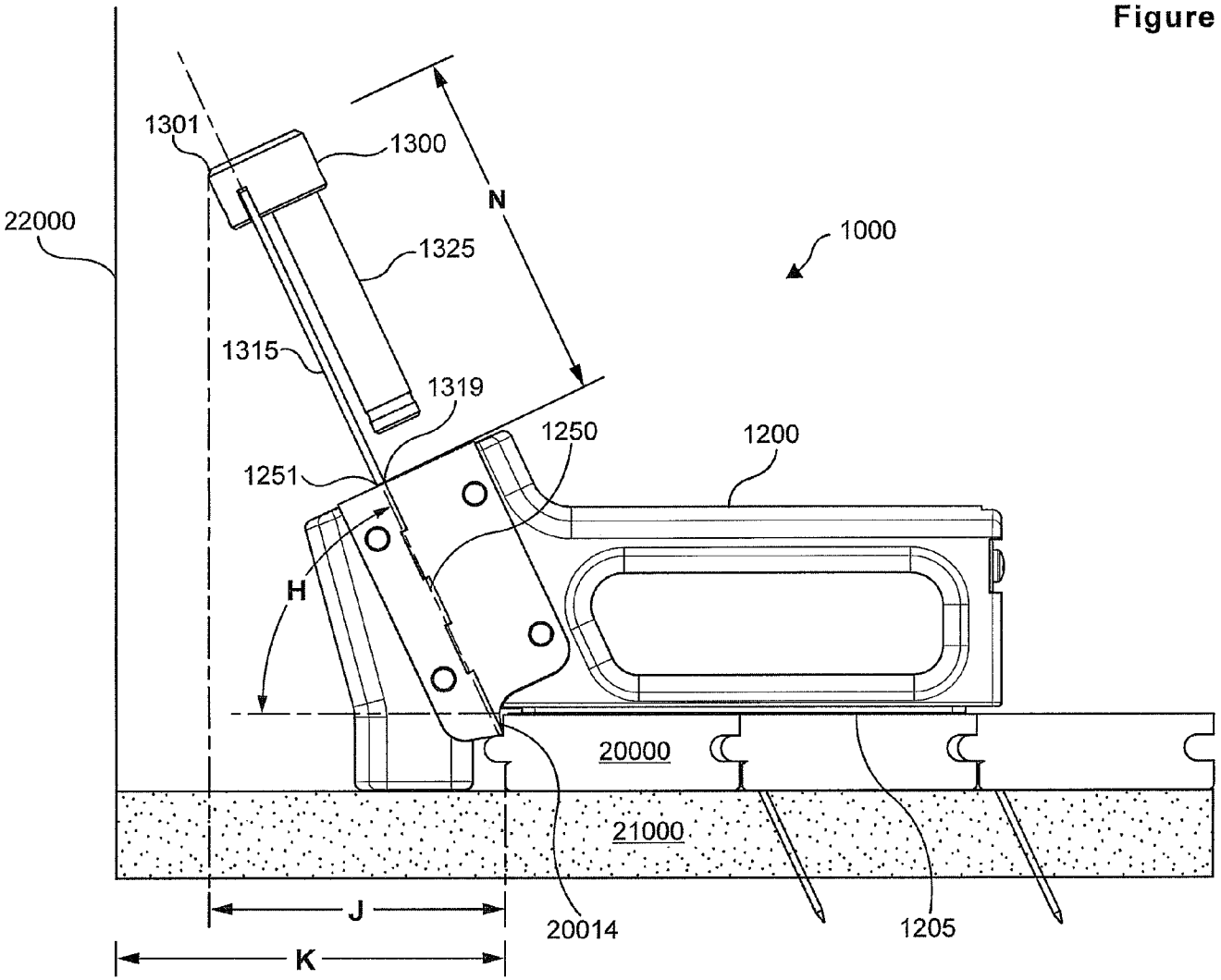
FIG. 17 is an elevated side view of the stapling tool of FIG. 12.

FIG. 17 shows how the assembled stapling tool 1000 is best able in close proximity to a wall to drive a hardwood flooring staple into the side of a hardwood flooring plank. Body 1200 is properly positioned on a plank 20000 being stapled to a subfloor 21000. An outer edge 20014 of plank 20000 is at a distance K in relation to a wall surface 22000. Stapling tool 1000 is capable of driving a hardwood flooring staple at distance K from wall surface 22000. Rod assembly 1300 is insertable in body 1200 with the staple driving end 1319 of staple driver 1315 entering at top staple slot opening 1251 of staple slot 1250. A centerline of staple driver 1315 forms an angle H of about 65 degrees in relation to a plane formed by base body surface 1205 resting on the top face of plank 20000. Staple driver 1315 will drive a staple at a 65 degree angle down the length of staple slot 1250 into hardwood plank 20000. This is made possible by the short distance J between outer edge 1301 of rod assembly 1300 and the outer edge 20014 of plank 20000.

Figure 18:
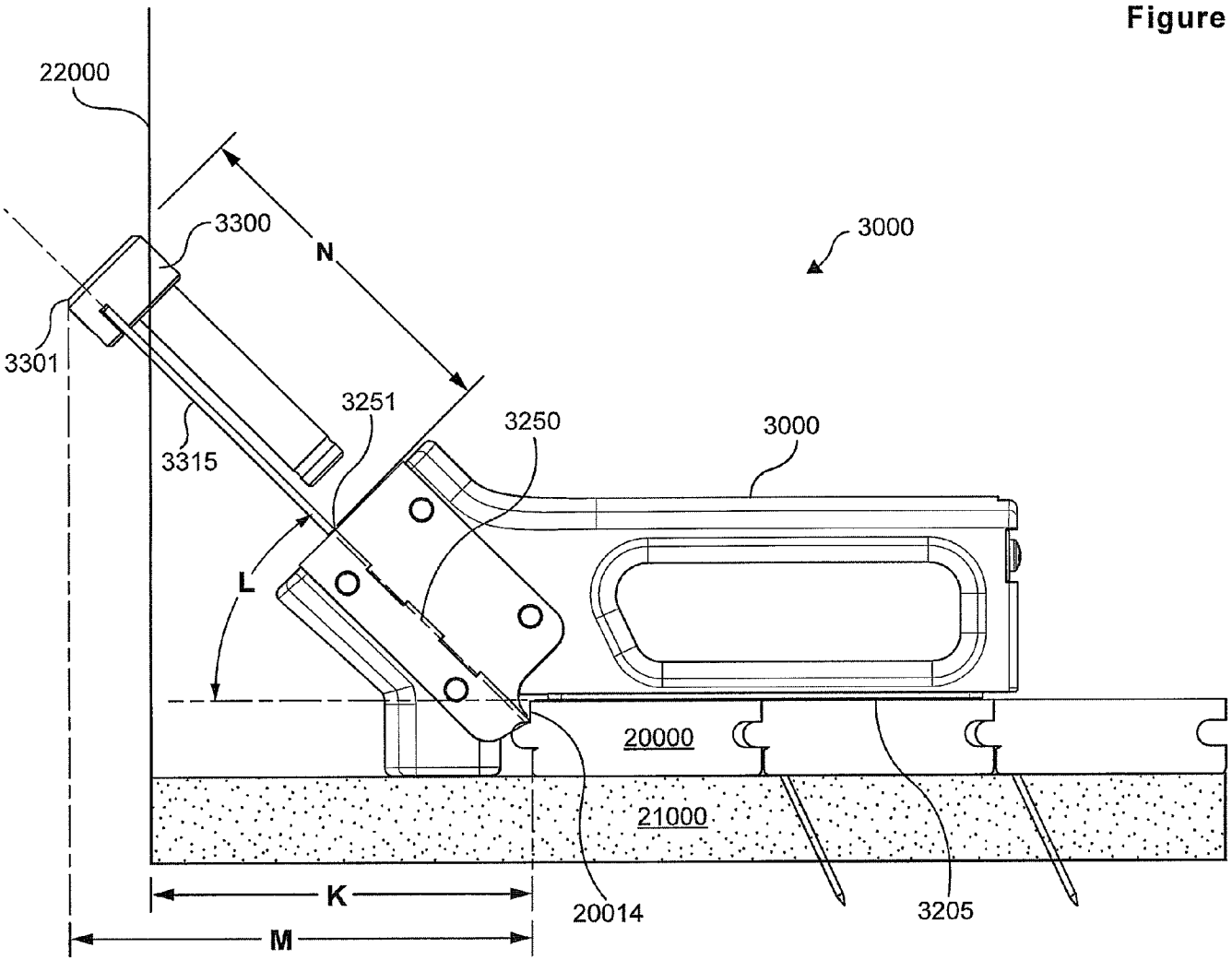
FIG. 18 is an elevated side view of a variation of the stapling tool of FIG. 12.

For comparison, FIG. 18 shows a stapling tool 3000 with a staple slot 3250 at a lesser angle L of about 45 degrees in relation to the plane formed by body base surface 3205. A rod assembly 3300 having the same dimensions (including overall length N) as rod assembly 1300 of FIG. 17 is hypothetically positioned at a top staple slot opening 3251 of 45 degree staple slot 3250. Stapling tool 3000 is placed in the same position in relation to a wall surface 22000 as stapling tool 1000 of FIG. 18. Distance K from an outer edge 20014 of plank 20000 to a wall surface 22000 is the same as distance K in FIG. 17. However, with stapling tool 3000 in this same position, an outer edge 3301 of rod assembly 3300 extends a greater distance M from the outer edge 20014 of plank 20000. In such a position, an outer edge 3301 of rod assembly 3300 would interfere with wall surface 22000, preventing it from being inserted at top staple slot opening 3251. Stapling tool 3000 is therefore not capable of performing a stapling operation when the outer edge 20014 of a hardwood plank 20000 is at a distance K from a wall surface 22000. The installer would have to glue or top nail that plank. By contrast, with stapling tool 1000 of FIG. 17, planks as close to plank 20000 could be stapled.

It is therefore apparent that the stapling tool 1000 embodiment shown in FIG. 17 as having a staple slot 1250 at a 65 degree angle in relation to a body base surface 1205 is preferred for stapling a plank in close proximity to a wall surface.

Figure 19:
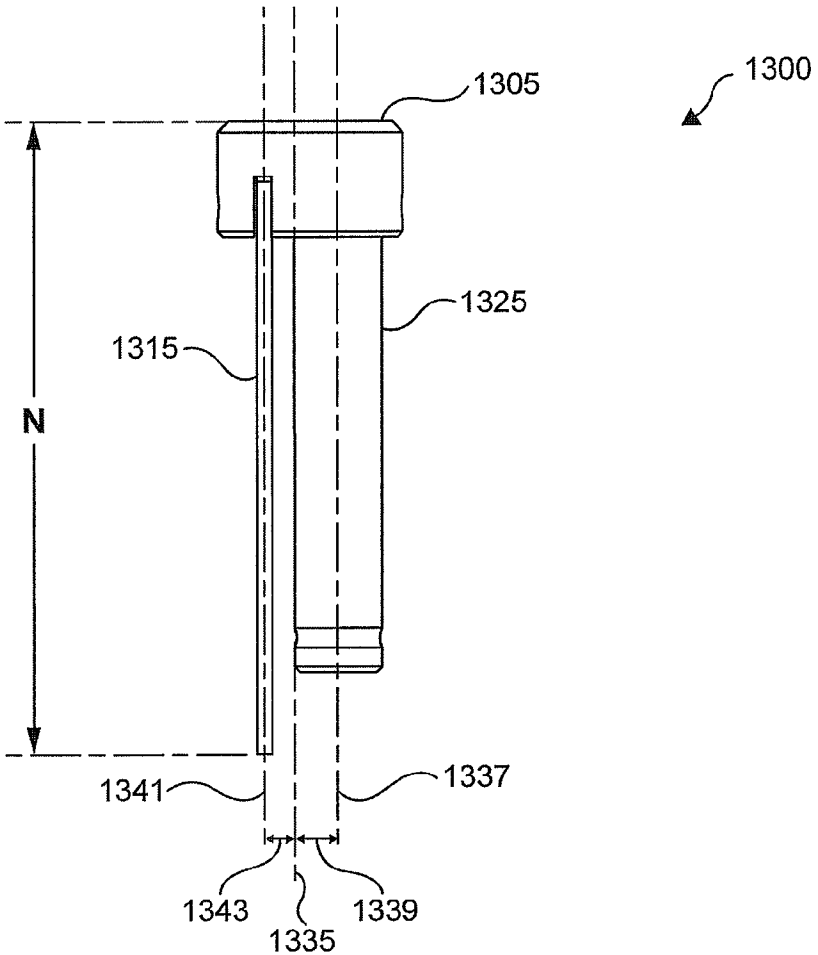
FIG. 19 is an elevated view of the rod assembly from the stapling tool of FIG. 12.

FIG. 19 shows a preferred embodiment of the rod assembly 1300 of FIGS. 12, 14, 16, and 17 in isolation. Rod assembly 1300 has an overall centerline 1335. Rod body 1325 has its own centerline 1337 that is offset a distance 1339 from the overall centerline 1335 of rod assembly 1300. Staple driver 1315 has its own centerline 1341. Centerline 1341 of staple driver 1315 is offset a distance 1343 from the overall centerline 1335 of rod assembly 1300. The rod body 1325 and the staple driver 1315 are in spaced apart parallel arrangement. The centerline 1341 of the staple driver 1315 is in spaced apart parallel arrangement with the centerline 1337 of the rod body 1325.

Forming hammering head 1305 and rod body 1325 from a single piece of material is preferred for maximum durability. However, as shown in FIG. 19, the centerline 1337 of rod body 1325 is offset from an overall centerline 1335 of rod body 1300. Such a part cannot be formed in a standard lathing operation, making it more expensive to manufacture. For reduced cost, hammering head 1305 and rod body 1325 may comprise separate elements fastened together.

Figure 20:
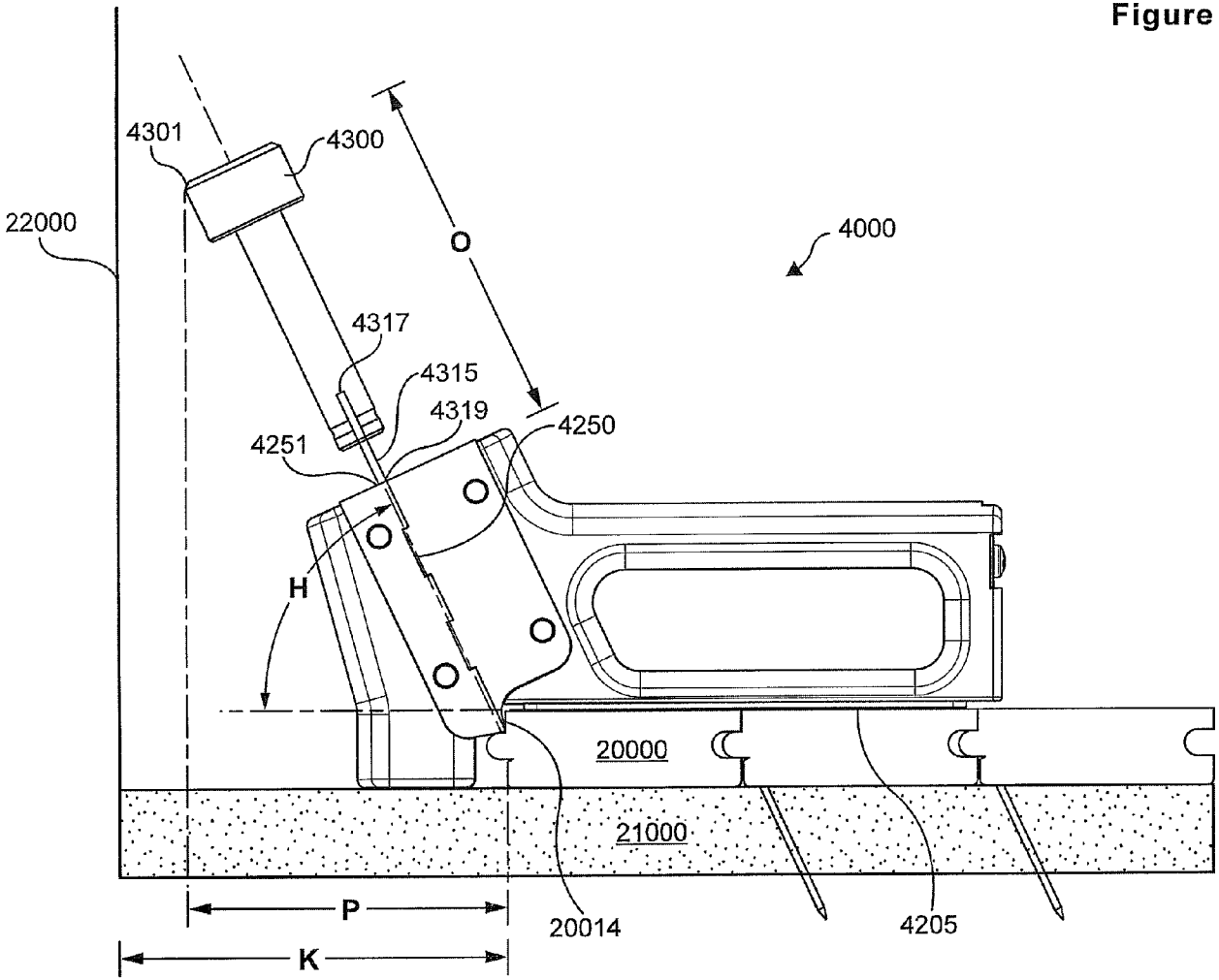
FIG. 20 is an elevated side view of stapling tool that is a variation of the set tool of FIG. 1 and the stapling tool of FIG. 12.

The offset distance 1343 of staple driver 1315 is preferred for stapling a hardwood plank in close proximity to a wall surface. FIG. 20 illustrates this comparatively by showing how close to a wall surface that a stapler could staple without such an offset staple driver. FIG. 20 shows a stapling tool 4000 with a rod assembly 4300 with a staple driver 4315 inserted within a slot 4317 formed on a centerline of rod assembly 4300. (This embodiment is similar to the rod embodiment of FIG. 9 having a tip 575 inserted into a center slot 570 of rod 500.) However, for comparison purposes, the overall length O of rod assembly 4300 is the same as that of as length N of preferred rod assembly 1300 in FIGS. 17 and 19.

As shown in FIG. 20, stapling tool 4000 is placed in the same position as stapling tool 1000 of FIG. 17. Distance K from an outer edge 20014 of plank 20000 to a wall surface 22000 is the same as distance K in FIG. 17. For comparison purposes, this places top staple slot opening 4251 of FIG. 20 in the same position as top staple slot opening 1251 of FIG. 17.

A staple driving end 4319 of staple driver 4315 of rod assembly 4300 is positioned at the same position at a top staple slot opening 4251 of staple slot 4250. Distance Pin FIG. 20 from an outer edge 4301 of rod assembly 4300 to an outer edge 20014 of plank 20000 is greater than distance J in FIG. 17 between outer edge 1301 of rod assembly 1300 and the outer edge 20014 of plank 20000.

Because distance P from an outer edge of a plank to the outer edge 4301 of rod assembly 4300 is greater, stapling tool 4000 cannot drive a hardwood flooring staple is as close to a wall surface as stapling tool 1000 of FIG. 17.

Because hardwood planks and the rooms in which they are installed can be of various sizes, a stapling tool which can staple a plank in closest proximity to a wall is desirable. Such a tool can staple planks to the subfloor in the widest variety of situations, preventing costly gluing or top nailing.

The embodiment of FIG. 12 has a staple slot 1250 designed to accept a single hardwood flooring staple. However, hardwood flooring staples used with prior art automatic stapling tools come in a laminated "brick" or strip containing numerous staples. A means of separating individual staples from a brick could improve the efficiency of stapling tool 1000.

As shown in FIG. 13, the body 1200 of stapling tool 1000 includes a staple separator 1500. Staple separator 1500 includes a blade 1505 having a sharpened edge 1506. Blade 1505 is fastened to body 1200 with two screws 1510. A slot 1515 is formed in body 1200 with a depth 1516 corresponding to a thickness 53 seen in FIG. 8 of a hardwood flooring staple (plus a small amount of clearance allowing the hardwood flooring staple to slide through after separation). With staple separator 1500, one end of the brick of staples can be inserted into slot 1515, with the points 55 and 56 in FIG. 8 of the end staple automatically positioned behind the blade. The brick of staples can be levered upward to create a force separating the end staple. The pointed ends of the staple, and the sharpened edge of the blade, produce wedging effects assisting the separation. Cleats such as cleat 5000 (FIG. 21) also come in a laminated brick form. Individual cleats can be separated with staple separator 1500.

The preferred rod assembly 1300 of FIGS. 12, 14, 16, and 17 is similar in some respects to the rod 500 of FIG. 9. Both rod assembly 1300 shown in FIG. 12 and rod 500 shown in FIG. 9 include a hammering head (hammering head 1305 in FIG. 12, and hammering end 507 in FIG. 9). The staple driving end of both embodiments includes a separate tip (staple driver 1315 of FIG. 12, and tip 575 of FIG. 9) which serves as a staple driving head. The separate tip may be made from a first, hardened material, different from a second material used to form the hammering head or other elements of the rod, preferably softer and tougher than the tip material. Therefore, both rod assembly 1300 (FIG. 12) and rod 500 are rod assemblies or staple driving assemblies comprising several components. Each separate tip 1315 and 575 is insertable into the respective staple slot 1250 and 250 of the respective stapling tool body 1000 and 200 (see staple slot 1250 of FIG. 12, and staple slot 250 of FIG. 1).

Further similarities between rod assembly 1300 of FIG. 12 and rod 500 of FIG. 9 include that each has a staple driving head configured to transfer impact from the head of a hammer to a hardwood flooring staple in the staple slot (see staple driving end 1319 of staple driver 1315 of FIG. 16, and tip 575 of FIG. 9). The staple driving head of both embodiments is operatively coupled to the hammering head of the rod assembly.

Staple driver 1315 of rod assembly FIG. 12 differs from tip 575 of rod 500 of FIG. 9 in that the staple driver 1315 is coupled to hammering head 1305, and the tip 575 is coupled to the body 505 of the rod 500 at the staple driving head 510 of the rod 500 opposing the hammering end 507. Furthermore, the rod assembly 1300 of FIG. 12 includes a rod body 1325 which functions primarily to support staple driver 1315 in the staple driving process. Rod body 1325 includes no staple driving end element. Lastly, as shown in FIG. 19, staple driver 1315, and rod body 1200 are offset from the overall centerline of rod assembly 1300. In the rod embodiment of FIG. 9, tip 575 is mounted on rod 500 in a slot 570 on the centerline of rod 500.

With respect to their body elements, the body 200 of the embodiment of FIG. 1 as well as the body 1200 of the embodiment of FIG. 12 are similar in that both bodies 200 and 1200 include a staple slot (staple slot 250 in FIG. 1, and staple slot 1250 of FIG. 12). Both bodies 200 and 1200 have a staple slot with a top staple slot opening or staple slot staple insertion point in a body top surface (see rectangular channels 255, 260 of FIG. 1, and top staple opening 1251 of FIG. 12). Both the staple slots also have a bottom staple slot opening or staple slot staple exit point (bottom openings of rectangular channels 255, 260 as shown in FIG. 4, and bottom staple slot opening 1252 of Section A-A of FIG. 14). When either body 200 of FIG. 7 or body 1200 of FIG. 14 is properly positioned on a hardwood plank to be stapled, the staple slot staple exit point of both tools is proximate to an external angle formed by an outside edge of said hardwood flooring plank, and the tongue of said hardwood flooring plank (channels 255, 260 forming staple slot 250 at staple insertion edge 220 of FIG. 7, and bottom staple slot opening 1252 of Section A-A of FIG. 14).

The bodies of the two embodiments differ in that staple slot 250 of the embodiment of FIG. 7 is at a 45 degree angle in relation to its body base surface 205. The staple slot 1250 of the embodiment in FIG. 12 is at a 65 degree angle in relation to body base surface 1205 (as shown in Section A-A of FIG. 14). The staple slot 1250 of the embodiment of FIG. 12 accepts the staple driver 1315 only. Other portions of the rod assembly 1300, such as rod body 1325, insert into the body 1200 at a separate rod body hole 1260.

What is claimed is:

1. A stapling tool for stapling hardwood tongue and groove flooring planks into a subfloor surface, comprising:

a body, including:

a) a body base surface;

b) a stop surface extending at an angle from said body base surface;

c) a body top surface; and d) a staple slot configured to guide a hardwood flooring staple from a staple slot staple insertion point in said body top surface to a staple slot staple exit point of the body that is insertable within an external angle formed by a tongue and an outside edge of a hardwood flooring plank as the body base surface rests on a top face of said plank; and a rod assembly, including:

i) a hammering head configured to receive an impact force from a head of a hammer; and ii) a staple driving head operatively coupled to said hammering head and configured to transfer said impact force to said hardwood flooring staple;

wherein said hardwood flooring staple, after being inserted into said staple slot staple insertion point in said body top surface followed by said staple driving head being inserted into same said staple slot in said body top surface, is guided by said staple slot and is drivable into said hardwood flooring plank at said external angle by said staple driving head in response to said impact force.

2. The stapling tool of claim 1, wherein the staple driving head includes a tip of differing material from the hammering head.

3. The stapling tool of claim 1 wherein the staple slot has a uniform and approximately rectangular cross-section dimensioned for a slidable fit of said hardwood flooring staple and slidably conforms to the staple driving head.

4. The stapling tool of claim 1, further including a recess in said body top surface, said recess having a depth less than or equal to a length of said hardwood flooring staple, said staple slot staple insertion point located in said recess, such that said hardwood flooring staple is manually insertable though a plane defined by said body top surface and into said staple insertion point in said recess.

5. The stapling tool of claim 1 further comprising a staple separator attached to an outside surface of the body.

6. A stapling tool for stapling tongue and groove hardwood flooring planks into a subfloor surface, comprising:

a stapling tool body, including:

a) a stapling tool body base surface for resting said stapling tool body on a top face of one or more hardwood flooring planks to be stapled; and b) a staple slot configured to guide a hardwood flooring staple from a staple slot staple insertion point to a staple slot staple exit point that is positionable within an external angle formed by a tongue and an outside edge of said hardwood flooring plank when said stapling tool body rests on one of said hardwood flooring planks, wherein said staple slot is at an angle greater than or equal to 50 degrees and less than or equal to 85 degrees in relation to a plane of said body base surface; and a rod assembly, including:

i) a hammering head configured to receive impact force from a head of a hammer; and ii) a staple driving head operatively coupled to said hammering head and configured to transfer said impact force to said hardwood flooring staple;

wherein said hardwood flooring staple, after being inserted into said staple slot staple insertion point followed by said staple driving head being inserted into same said staple slot staple insertion point, is drivable into said hardwood flooring plank at said external angle by said staple driving head in response to said impact force, guided by said staple slot.

7. The stapling tool of claim 6, wherein the staple driving head includes a tip of a first material differing from a second material of the hammering head.

8. The stapling tool of claim 6, wherein:

said stapling tool body has a rod body hole;

said rod assembly further includes:

a staple driver operatively coupled to the hammering head and having the staple driving head; and a rod body coupled to the hammering head; and wherein said staple driver is insertable into said staple slot, and said rod body is insertable into said rod body hole.

9. The stapling tool of claim 8, wherein a centerline of said staple driver is offset from a centerline of said rod assembly.

10. The stapling tool of claim 6, wherein said stapling tool body includes at least one insert arranged to form a portion of said staple slot.

11. The stapling tool of claim 6, wherein said stapling tool body includes two inserts that form opposed first and second and opposed third and fourth surfaces of said staple slot.

12. The stapling tool of claim 11, wherein said two inserts include interlocking toothed regions forming said opposed first and second surfaces of said staple slot.

13. The stapling tool of claim 6, wherein said stapling tool body includes a staple separator having a slot in an outer surface of said body, and a blade mounted over said slot in said body.

14. A stapling tool for stapling hardwood tongue and groove flooring planks into a subfloor surface, comprising:

a body, including:

a) a body base surface;

b) a body top surface;

c) a staple slot configured to guide a hardwood flooring staple from a staple slot staple insertion point in said body top surface to a staple slot staple exit point of the body that is insertable within an external angle formed by a tongue and an outside edge of a hardwood flooring plank as the body base surface rests on a top face of said plank; and, a rod assembly, including:

i) a hammering head configured to receive impact force from a head of a hammer;

ii) a rod body insertable to a rod hole in the body at a rod hole opening and guided by the rod hole; and iii) a staple driver operatively coupled to the hammering head, insertable to and guided by the staple slot and configured to transfer said impact force to said hardwood flooring staple;

wherein said staple, manually inserted into said staple slot staple insertion point followed by said staple driver, is guided by said staple slot and driven into said hardwood flooring plank at said angled region by said staple driver in response to said impact force;

wherein said staple driver includes a driving head inserted into same staple slot in said body top surface.

15. The stapling tool of claim 14 wherein a first centerline of the rod hole and a second centerline of the staple slot are in spaced apart parallel arrangement.

16. The stapling tool of claim 14 wherein the rod body and the staple driver are in spaced apart parallel arrangement.

17. The stapling tool of claim 14 wherein the rod hole and the staple slot are in spaced apart arrangement.

18. The stapling tool of claim 14 wherein the staple driving assembly is cooperatively guided and prevented from rotating by the rod hole and the staple slot.

19. The stapling tool of claim 14 wherein:

the staple slot has an approximately rectangular cross-section; and the rod body and the rod hole have close-fitting, complementary cross-sections.

20. The stapling tool of claim 14 wherein the staple slot has a uniform and approximately rectangular cross-section dimensioned for a slidable fit of said hardwood flooring staple and said staple driver.

21. The stapling tool of claim 14, further including a recess in said body top surface, said recess having a depth less than or equal to a length of said hardwood flooring staple, said staple slot staple insertion point located in said recess, such that said hardwood flooring staple is manually insertable though a plane defined by said body top surface into said staple insertion point in said recess.

* * * * *